US007800032B1

(12) United States Patent
Facciano et al.

(10) Patent No.: US 7,800,032 B1
(45) Date of Patent: Sep. 21, 2010

(54) DETACHABLE AERODYNAMIC MISSILE STABILIZING SYSTEM

(75) Inventors: Andrew B. Facciano, Tucson, AZ (US); Robert T. Moore, Tucson, AZ (US); Craig D. Seasly, Tucson, AZ (US); Richard A. McClain, Tucson, AZ (US); Raymond J. Spall, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 297 days.

(21) Appl. No.: 11/606,763

(22) Filed: Nov. 30, 2006

(51) Int. Cl.
*F42B 15/01* (2006.01)

(52) U.S. Cl. ..... 244/3.24; 244/3.25; 244/3.27

(58) Field of Classification Search ..... 244/3.1, 244/3.24, 3.25, 3.28, 3.27
See application file for complete search history.

(56) References Cited

U.S. PATENT DOCUMENTS

| | | | | | |
|---|---|---|---|---|---|
| 2,597,703 | A * | 5/1952 | Busacker | 244/3.25 |
| 2,992,794 | A * | 7/1961 | Boyd | 244/3.15 |
| 3,047,259 | A * | 7/1962 | Tatnall et al. | 244/138 A |
| 3,141,409 | A * | 7/1964 | Travis et al. | 102/399 |
| 3,152,545 | A * | 10/1964 | Potts, Jr. | 102/387 |
| 3,251,301 | A * | 5/1966 | Herrmann | 244/3.25 |
| 3,430,900 | A * | 3/1969 | Chase et al. | 244/3.23 |
| 4,667,899 | A * | 5/1987 | Wedertz | 244/49 |
| 4,722,496 | A * | 2/1988 | Herrmann et al. | 244/3.25 |
| 4,964,593 | A * | 10/1990 | Kranz | 244/3.24 |
| 5,048,773 | A * | 9/1991 | Washington et al. | 244/3.28 |
| 5,642,867 | A * | 7/1997 | Klestadt | 244/49 |
| 5,806,791 | A * | 9/1998 | Hatalsky et al. | 244/3.24 |
| 6,073,879 | A * | 6/2000 | Sokolovsky et al. | 244/3.28 |
| 6,343,954 | B1 | 2/2002 | Facciano et al. | |
| 6,460,807 | B1 * | 10/2002 | Braitinger et al. | 244/133 |
| 6,540,176 | B2 * | 4/2003 | Davis et al. | 244/3.24 |
| 6,666,402 | B2 * | 12/2003 | Rupert et al. | 244/3.27 |
| 6,869,044 | B2 * | 3/2005 | Geswender et al. | 244/3.29 |
| 7,347,147 | B2 * | 3/2008 | Bar et al. | 102/473 |
| 2002/0130216 | A1 * | 9/2002 | Facciano et al. | 244/3.24 |
| 2004/0108412 | A1 * | 6/2004 | Moore et al. | 244/3.24 |
| 2004/0124306 | A1 * | 7/2004 | Brown et al. | 244/3.1 |
| 2004/0164202 | A1 * | 8/2004 | Klestadt et al. | 244/3.24 |
| 2005/0151000 | A1 * | 7/2005 | Dodu et al. | 244/3.24 |
| 2007/0018033 | A1 * | 1/2007 | Fanucci et al. | 244/3.27 |
| 2007/0075183 | A1 * | 4/2007 | Fisch et al. | 244/3.25 |
| 2007/0102568 | A1 * | 5/2007 | Higgins et al. | 244/3.25 |
| 2008/0006736 | A1 * | 1/2008 | Banks | 244/3.21 |
| 2009/0045286 | A1 * | 2/2009 | King et al. | 244/123.4 |

FOREIGN PATENT DOCUMENTS

| | | |
|---|---|---|
| DE | 4025516 A1 | 2/1992 |
| JP | 2000-28295 A | 1/2000 |

* cited by examiner

*Primary Examiner*—Christopher P Ellis
(74) *Attorney, Agent, or Firm*—Glenn H. Lenzen; Polsinelli Shughart PC

(57) ABSTRACT

Provided is a detachable aerodynamic missile stabilizing system for a missile flying at low flight speeds. The system includes a housing adapted to couple to couple to the missile. Extending outward from the housing is at least one grid fin. Specifically the grid fin extends from the housing such that it is transverse to a longitudinal axis of the housing and the missile. The grid fin provides a plurality of apertures. The apertures are parallel to the longitudinal axis of the housing and the missile. A coupler is adapted to detachably couple the housing to the missile. A method of use is also provided.

10 Claims, 7 Drawing Sheets

DETACHABLE AERODYNAMIC MISSILE STABILIZING SYSTEM

FIELD

This invention relates generally to the field of missile control system, and more specifically to a detachable aerodynamic missile stabilizing system for use during launch to cause the missile to pitch over rapidly while maintaining roll stability.

BACKGROUND

Offensive missiles such as any number of cruise missiles, are constructed to fly at low altitudes (i.e., just above tree tops or water surfaces) so as to avoid detection by the targeted party's radar. In such a situation a targeted ship, for example, may have just a few seconds to first identify the thread and then take countermeasures, such as the launching of one of its defensive missiles.

Typically, a land or ship born defensive missile is launched from a canister or missile launcher in a generally vertical direction. Such a defensive missile must attain a sufficient velocity before its airfoil surfaces are able to perform any substantial maneuvers. This generally translates into having the missile reach an altitude of thousands of feet before it is able to pitch over and begin seeking the incoming missile threat. For long range threats this high altitude pitch over is a common design characteristic and is therefore a common element in existing defense missile systems.

Given the low altitudes of threat missiles and the consequential small window for identification and reaction, such a high altitude for pitch over is problematic. More specifically, given the limited timeframe to successfully determine an intercept solution and the high speeds of the threat missiles, it may not be possible to optimize the intercept trajectory due to the lack of launch maneuverability and stability. There exists a very real possibility of overshooting the target or expending too much time and fuel with large arching course corrections resulting in missed intercept opportunities.

Common missile control systems incorporate a number of different technologies by which guidance control and vehicle stability are provided to a missile, however attempts to adapt these systems to address this low speed guidance control and stability problem have not been complete.

Control surfaces such as wings and canards that are actuated during flight essentially interrupt the airflow around the missile body for high speed control authority. If sized for high speed use they are ineffective at low speeds. If sized for low speed they are large, heavy and likely not to fit within the launch frame or canister.

Movable nozzle systems are heavy and complicated. As they are not detachable they add to the overall vehicle weight and degrade overall performance after they have fulfilled their purpose at low speed. In addition, nozzle systems frequently do not provide sufficient thrust vector angles as are required for low speed guidance control and vehicle stability to meet a rapidly approaching low altitude threat that has been detected only a short time period away from impact.

Thrust vector control ("TVC") systems typically incorporate movable nozzles, jet tabs, or jet vanes, the latter offering roll control but substantially degrading rocket motor kinematic performance by impinging propellant flow. TVC thrust redirection systems steer the missile from the aft rocket nozzles. These systems are ineffective after motor burn-out and again are often heavy and costly devices resulting in significant vehicle weight increase and subsequent overall missile performance degradation.

Missile jet vane control systems have been shown to be effective at providing low speed guidance control and stability. However, as the jet vanes are placed in the flow of the missile exhaust they do impact missile motor performance. In addition, jet vane control systems require the use of low smoke, low energy propellant grains to enable the jet vanes to survive the nozzle plasma flow environments and are therefore not suitable for use with many currently existing and intended rocket motor designs.

Moreover, despite various prior art attempts, missile control at launch and within the period after launch before the missile obtains sufficient high speed velocity to utilize its traditional control surfaces has remained problematic and elusive. Given the large variety of currently existing defensive missile inventories, individualized customization and/or modification is undesirable. The redesign of motors is both costly and time intensive and may in many cases lead to additional disposal costs of hazardous materials as fuel systems are replaced.

Hence, there is a need for a missile stabilization system that overcomes one or more of the issues and problems identified above.

SUMMARY

This invention provides a detachable missile stabilization system and associated method.

In particular, and by way of example only, according to one embodiment of the present invention, provided is a detachable aerodynamic missile stabilizing system for stabilizing a missile at low flight speeds, the missile having a forward portion and an aft portion, including: a housing adapted to couple to the missile; at least one grid fin extending transversely from the housing, the grid fin providing a plurality of apertures; and a coupler adapted to detachably couple the housing to the missile.

In yet another embodiment, provided is a method of providing aerodynamic missile stability at low flight speed , the missile having a forward portion, an aft portion, a longitudinal center portion therebetween, and a flight control system, including: providing a grid fin interstage assembly having a housing with a central axis and at least one grid fin extending from the housing transverse to the central axis, the grid fin providing a plurality of apertures parallel to the center portion; coupling the grid fin interstage assembly to the aft portion of the missile, the central axis of the grid fin interstage assembly imposed upon a central axis of the missile; in response to missile launch, the grid fin interstage assembly establishing increased lift and drag at low flight speed; detaching the grid fin interstage assembly as the missile transitions from low flight speed to high flight speed.

DETAILED DESCRIPTION

Before proceeding with the detailed description, it is to be appreciated that the present teaching is by way of example only, not by limitation. The concepts herein are not limited to use or application with a specific system or method for route planning whether in a maritime environment or other environment. Thus, although the instrumentalities described herein are for the convenience of explanation, shown and described with respect to exemplary embodiments, it will be appreciated that the principles herein may be applied equally in other types of systems and methods involving missile and/or rocket stabilization at low speeds.

Figure 1:
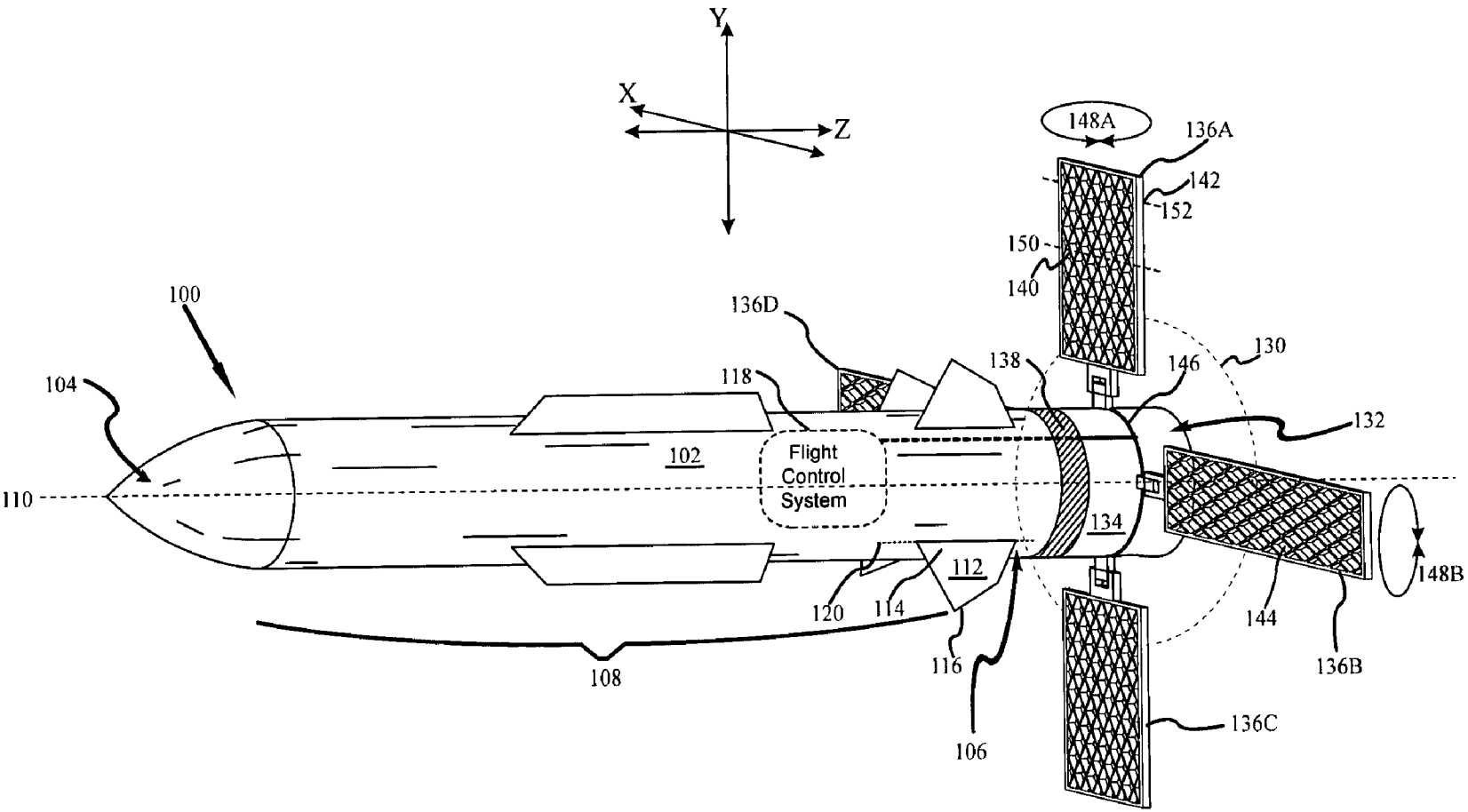
FIG. 1 is a perspective view of a missile provided with a detachable aerodynamic missile stabilizing system according to an embodiment.

Turning now to the figures, and more specifically to FIG. 1, there is shown a missile 100 having a body 102 with a forward portion 104 and an aft portion 106 and a longitudinal center portion 108 therebetween, the longitudinal center portion generally circumferential about longitudinal axis 110. The missile also has tail fins 112 which are aligned to extend substantially parallel to longitudinal axis 110. Moreover, as the longitudinal axis 110 is parallel to the Z-axis, each tail fin 112 is also aligned parallel to the Z-axis, the alignment represented by dotted line 120 which is clearly parallel to the longitudinal axis 110. As such the opposing sides 114, 116 of each tail fin 112 provide aerodynamic control surfaces for articulation and missile flight control at high velocity.

Missile 100 has been fitted with detachable aerodynamic missile control system 130. In at least one embodiment, the detachable aerodynamic missile control system 130 includes a grid fin interstage assembly ("GFIA") 132, having a housing 134 and at least one grid fin 136. As shown in the illustrations, at least one grid fin 136 extends outwardly from the housing 134. The housing 134 and at least one grid fin 136 as the GFIA 132 are detachably coupled in at least one embodiment to the aft portion 106 of the missile 100 by a coupler 138.

In at least one alternative embodiment, not shown, GFIA 132 is coupled to the missile between the forward portion 104 and the aft portion 106 of the missile 100. In such an embodiment the housing of GFIA 132 may clamp around the exterior of the missile 100 rather than fitting in line with it as shown in the accompanying figures.

At least one purpose of the GFIA 132 is to provide drag upon the missile shortly after launch, i.e., while the missile 100 has a low velocity. At least one additional purpose of the GFIA 132 is to provide additional lift and control surfaces to further missile stability while the missile 100 has a low velocity. As in the absence of the FGIA 132 the missile is subject to pitch instability, coupling to the aft portion 106 is generally preferred. This lift and drag increase permits missile stabilization and pitch-over to occur more rapidly. Where the GFIA 132 employs grid fins 136 that are operable to articulate, the imparted lift and drag may be controlled to further reduce the time to missile pitch over.

As noted above, for a typical missile the tail fins 112 are intended to provide control at high speed. In addition to imparting drag upon the missile 100 to induce pitch over more rapidly, the grid fins 136 may also impart lift and thus provide additional stability when the orientation of the missile 100 is such to present an angle of attack to the component surfaces of the grid fin 136.

As shown in FIG. 1, in at least one embodiment there are at least four grid fins of which 136A~136D are exemplary. Whereas the tail fins 112 are substantially parallel to the longitudinal axis 110, the grid fins 136 are transverse to the housing 134, and more specifically transverse to the longitudinal axis 110. Specifically, the primary opposing sides 140, 142 are transverse to longitudinal axis 110 as they are parallel to the X-axis. See dotted lines 150, 152 representing the alignment of opposing sides 140, 142.

Each grid fin 136 provides a plurality of apertures 144, between opposing sides 140 and 142. In at least one embodiment these apertures 144 are arranged in a grid pattern. Whereas the grid fin 136 itself is transverse to the longitudinal axis 110, the apertures 144 are generally parallel to the longitudinal axis 110. In other words the grid fin 136 is a lattice structure, i.e. a non-solid surface which disrupts the air flow about the missile 100 and induces lift and drag upon the missile 100 and in at least one embodiment, at the aft of the missile.

In at least one embodiment, GFIA 132 also provides an articulation control system 132 operable to permit articulation of the grid fins 136A-136D. When GFIA 132 is coupled to the missile 100 by coupler 138, articulation control system 132 is also coupled to the missile control system 132. As such, missile control system 132 may articulate each grid fin 136 to further enhance and achieve low speed stability and orientation. Such articulation is illustrated by arrow 148A with respect to grid fin 136A and arrow 148B with respect to grid fin 136B.

Figure 2:
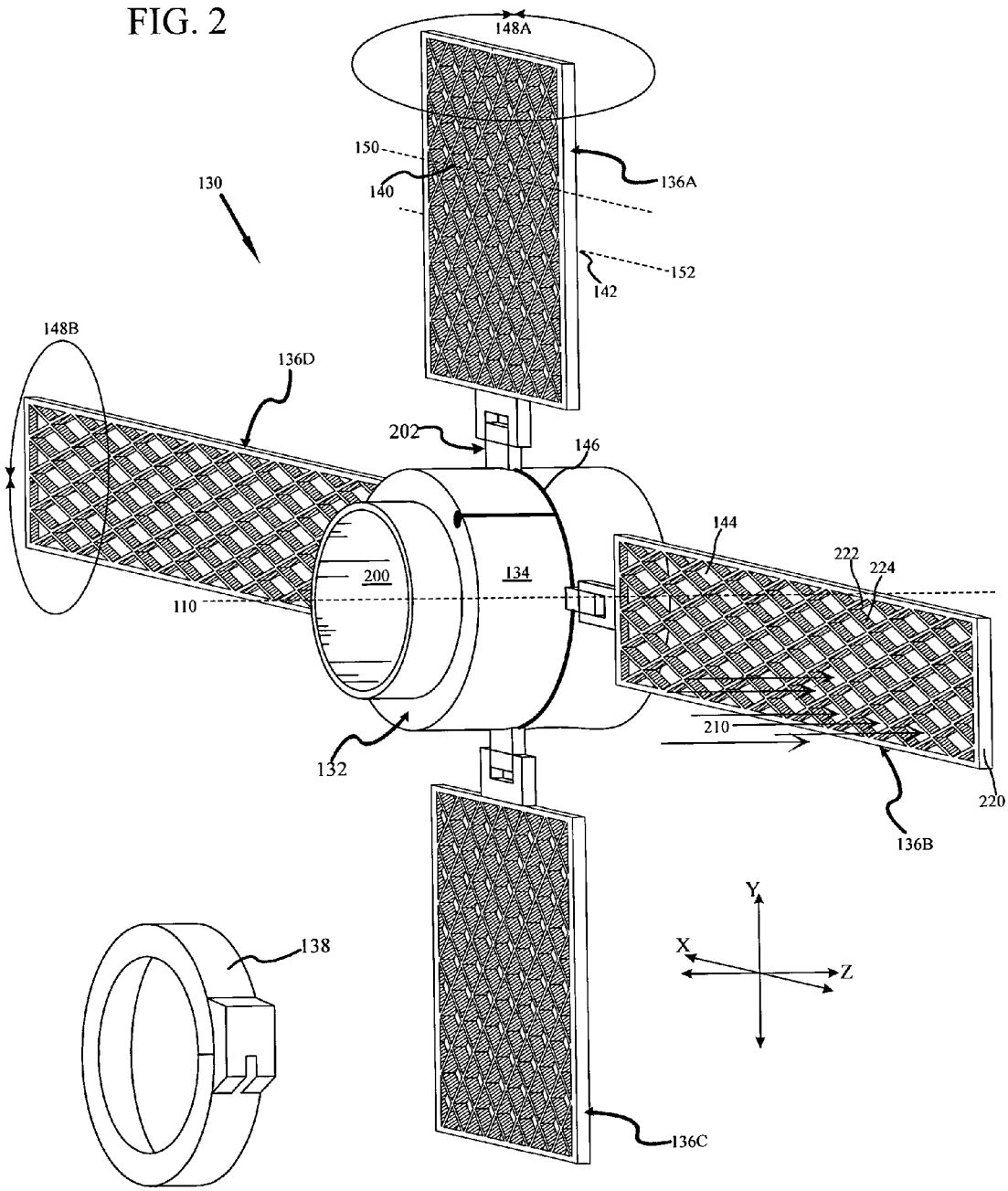
FIG. 2 is an enlarged view of the detachable aerodynamic missile stabilizing system shown in FIG. 1.
Figure 3:
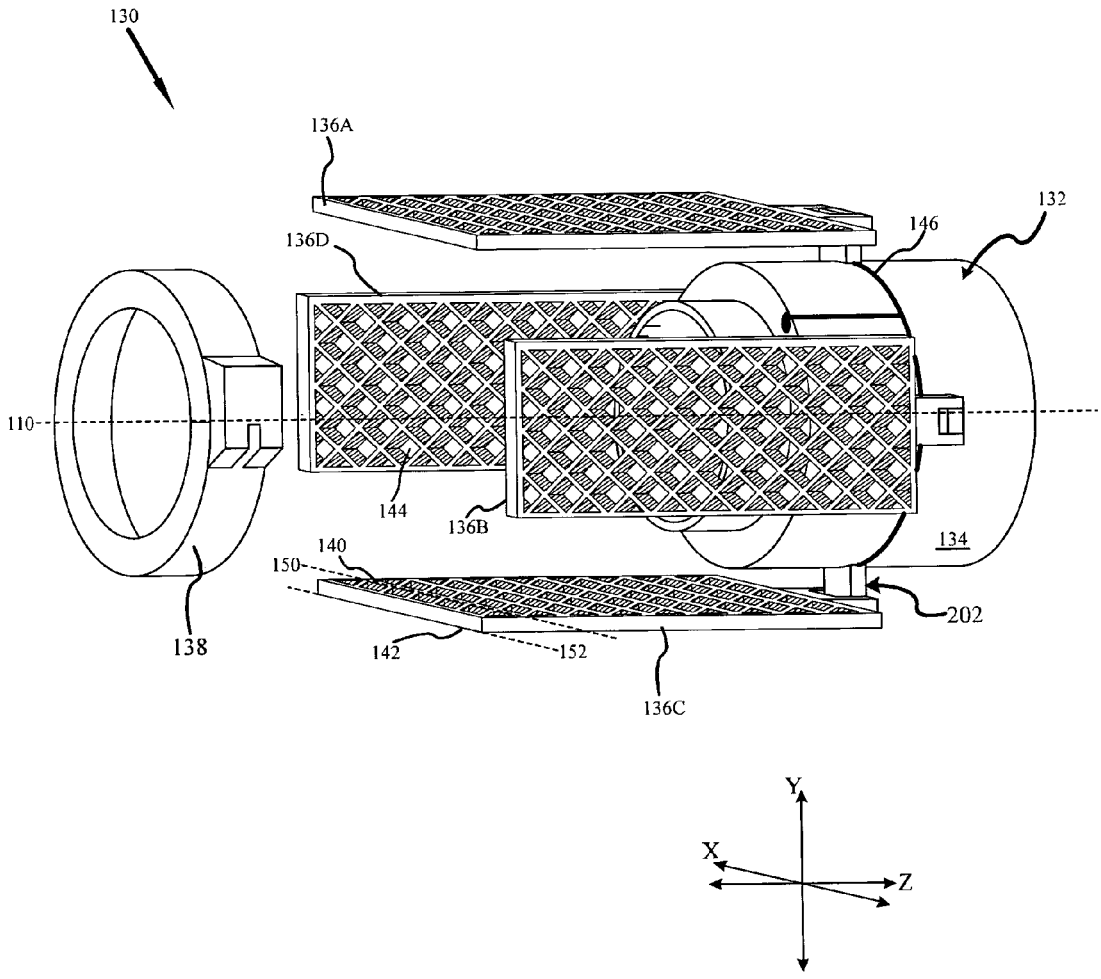
FIG. 3 is an enlarged view of the detachable aerodynamic missile stabilizing system of FIG. 2 showing the grid fins in a stowed orientation according to an embodiment.
Figure 4:
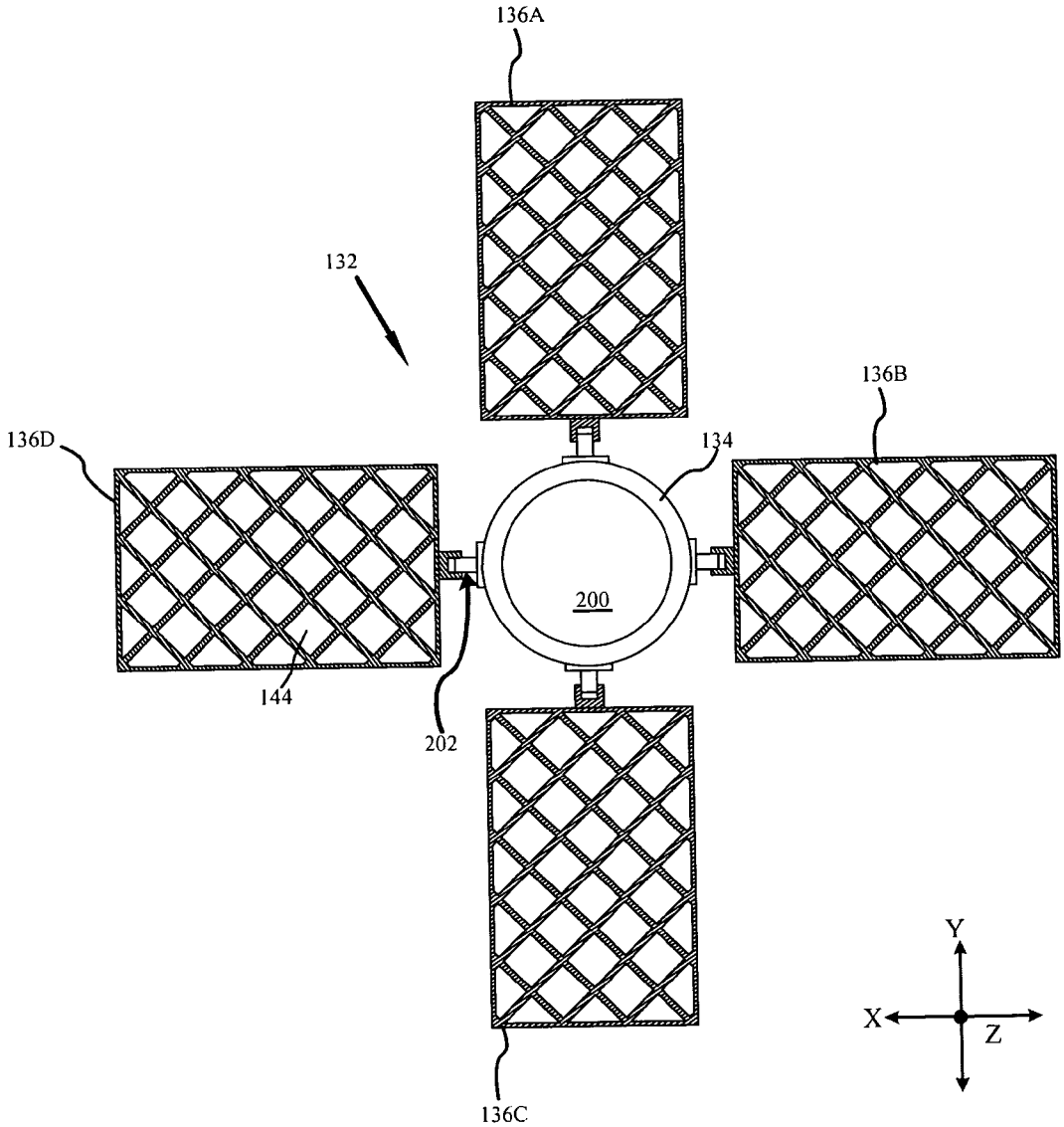
FIG. 4 is a face view of the detachable aerodynamic missile stabilizing system shown in FIG. 3.

An embodiment of the detachable aerodynamic missile control system 130 is shown separately and enlarged in the perspective views of FIGS. 2 and 3, and the face view of FIG. 4. An alternative embodiment of the detachable aerodynamic missile control system 130 wherein the grid fin is a single grid fin extending circumferentially about the housing is shown in the perspective view of FIG. 5 and the face view of FIG. 6.

With respect to FIGS. 1-8 it is appreciated that GFIA 132 is constructed to be retrofit to existing missiles, such as for example SM6 MR (Standard Missile 6 Medium Range), ESSM (Evolve Seas Sparrow Missile), RAM (Rolling Airframe Missile), SM3 (Standard Missile 3), SDB (Small Diameter Bomb), AMRAAM (Advanced Medium Range Air to Air Missile), AIM-9X (Air Intercept Missile 9X), and HARM (High Speed Anti-Radiation Missile), where low speed control authority is desirable. The GFIA 132 may also be coupled to new missile systems.

As may be appreciated in FIG. 2, each grid fin 136A~136D has side surfaces, of which surface 220 is exemplary. In addition each aperture 144 has at least one side surface, of which side surfaces 222 and 224 are exemplary. For each grid fin, these surfaces 220, 222, 224 provide additional surface area that collectively may provide increased lift when the angle of the missile 100 is such that one or more of these surfaces present an angle of attack.

With respect to FIG. 2, for embodiments wherein the GFIA 132 is attached to the aft portion 106 of a missile, the housing is appreciated to have a hollow passage 200 such that the rocket plume will pass through without impingement. In at least one embodiment, the internal passage 200 is a nozzle extension cone that receives and further directs the plume through the GFIA 132. As the grid fins 136 are disposed about the outside of the housing 134 and therefore are not subjected to the plume, modifications to the propellant and/or fabrication of the grid fins 136 from plume resistant materials is not required.

Gimbals, gear train assemblies, articulation devices and/or drive train devices are commonly used to control the orientation of missile tail fins and are commercially available. In at least one embodiment, a commercially available drive train device conventionally employed to control tail fins is adapted to control the grid fins 136. In at least one embodiment the drive train is an integral component to the supports 202 connecting each grid fin 136 to the housing 134. A communication link, such as articulation control system 146 provides a point of connection to link the drive train for each grid fin 136 with the missile control system.

As GFIA 132 is intended to provide lift and drag induced attitude and pitch stability for the missile 100 at low velocity, it will also impinge upon missile performance at high velocity. As such, GFIA 132 is constructed as an interstage element to be released from the missile 100. More specifically, once stability of the missile has been reached at high subsonic speeds on the established flight trajectory where the traditional missile guidance system and components are capable of effectuating missile stability and control, the coupler 138 is released and the GFIA 132 is released for separation and disposal.

In at least one embodiment, the coupler 138 is a V-band clamp. More specifically, in at least one embodiment the coupler 138 is a Marman clamp engagement system as is known and used in the missile arts. It is further understood and appreciated that GFIA 132 may provide a second coupler (not shown) at the aft section of the GFIA 132 such that a nozzle extension cone or other interstage assembly may be coupled to the aft portion of GFIA 132 opposite from the missile 100.

As may be appreciated with respect to FIG. 2, whereas a solid control surface would redirect air and/or block the flow of air, air, represented as arrows 210 is permitted to pass through the apertures 144 of the grid fins 136. By utilizing a grid of apertures 144 a known and generally consistent lift coefficient is provided. The size and configuration of the apertures 144 is selected based on design parameters so as to provide desired drag and lift coefficients less and more than a solid surface respectively.

As shown with respect to both FIGS. 2 and 3, in at least one embodiment the grid fins are selectively movable between a first stowed position (shown in FIG. 3) and a second deployed position (shown in FIG. 2). As shown in FIG. 3, in at least one embodiment this first stowed position is lying down and extending forward along the housing 134. When the missile is launched, the forward inertia and passage of air may help to deploy the grid fins 136 from their stowed position to their deployed position. Spring mechanisms within or adjacent to the supports 202 may also be employed to assist with the deployment of the grid fins 136.

As the grid fins 136 permit air to pass through them, there is a relatively small hinge moment involved given the relative apparent size of each grid fin 136. As such supports 202 should not require elaborate measures or design characteristics to support the grid fins during the low velocity period of travel wherein the grid fins 136 are employed.

FIG. 4 provides a face on view of the GFIA 132 which further permits appreciation of the relative simplicity of the GFIA 132 as an element of the detachable aerodynamic missile control system 130. In at least one embodiment, the grid fins 136 are composed of metal or composite materials as are typically utilized in missile design and fabrication.

Figure 5:
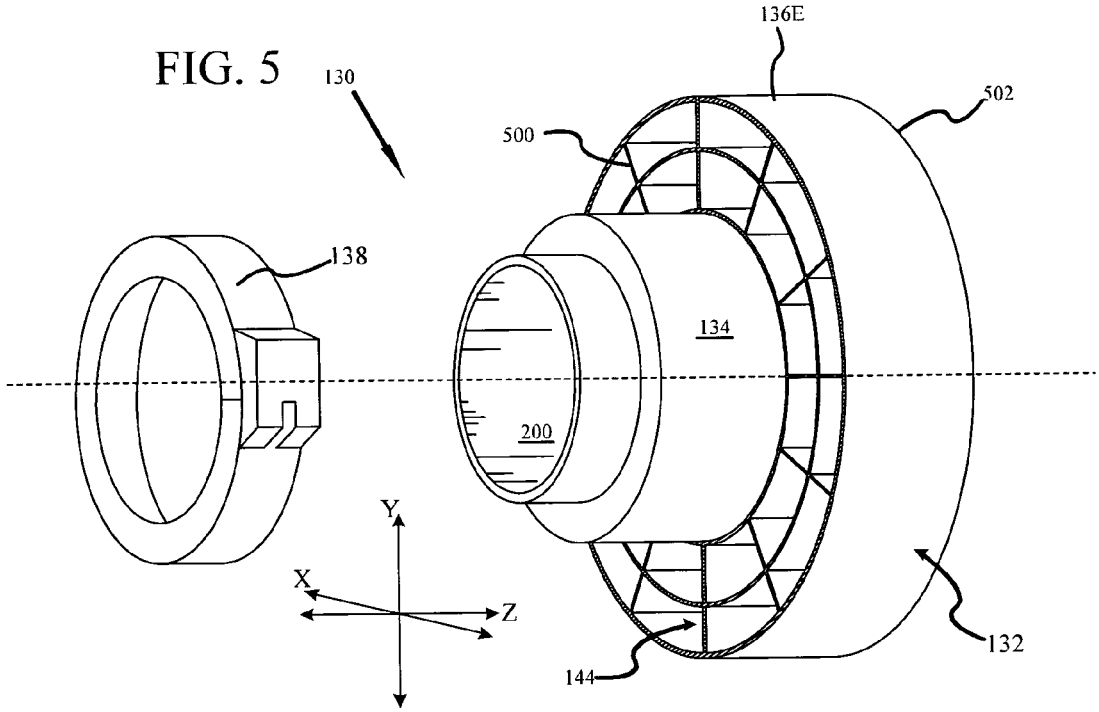
FIG. 5 is a perspective view of an alternative embodiment of the detachable aerodynamic missile stabilizing system.
Figure 6:
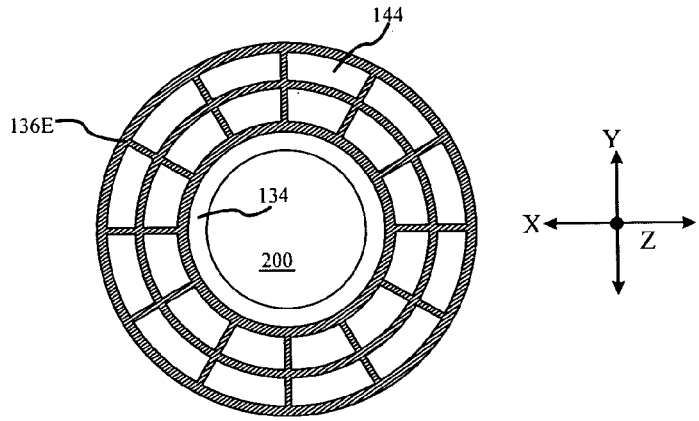
FIG. 6 is a face view of the detachable aerodynamic missile stabilizing system shown in FIG. 5.

With respect to the above descriptions and discussion regarding FIGS. 1 through 4 it is appreciated that GFIA 132 provides a plurality of grid fins 136. As shown in FIGS. 5 and 6, in at least one embodiment, the grid fin is a single grid fin 136E extending circumferentially about the housing 134. As in the case of the plurality of grid fins, e.g. 136A~136D discussed above, the circumferential grid fin 136E extends transversely from the housing 134, and more specifically transversely to the longitudinal axis 110 of the housing 134, see FIG. 5.

More specifically, circumferential grid fin 136E has primary opposing sides 500, 502 transverse to longitudinal axis 110 as they are parallel to the X-axis. Again, as described above with respect to grid fins 136A~136D, the circumferential grid fin 136E provides a plurality of apertures 144 and as such does not provide a substantial solid surface when viewed face on as in FIG. 6.

As in an embodiment providing multiple grid finds 136A~136D, the apertures 144 of circumferential grid fin 136E enable the circumferential grid fin 136E to provide additional lift and drag. This lift and drag permits improved missile stability at low velocity and permits pitch over to advantageously occur quickly after launch.

As many conventional missiles are launched from a canister, it is not uncommon for the typical flight control surfaces such as tail fins to fold against the body of the missile 100 when the missile 100 is within such a canister or otherwise in storage. As shown and described above with respect to FIGS. 2 and 3, for at least one embodiment utilizing a plurality of grid fins 136, the grid fins 136 are selectively movable between a stowed position and a deployed position. In FIG. 1, GFIA 132 is shown coupled to missile 100 such that the grid fins 136A~136D are aligned between deployed tail fins 112.

Figure 7:
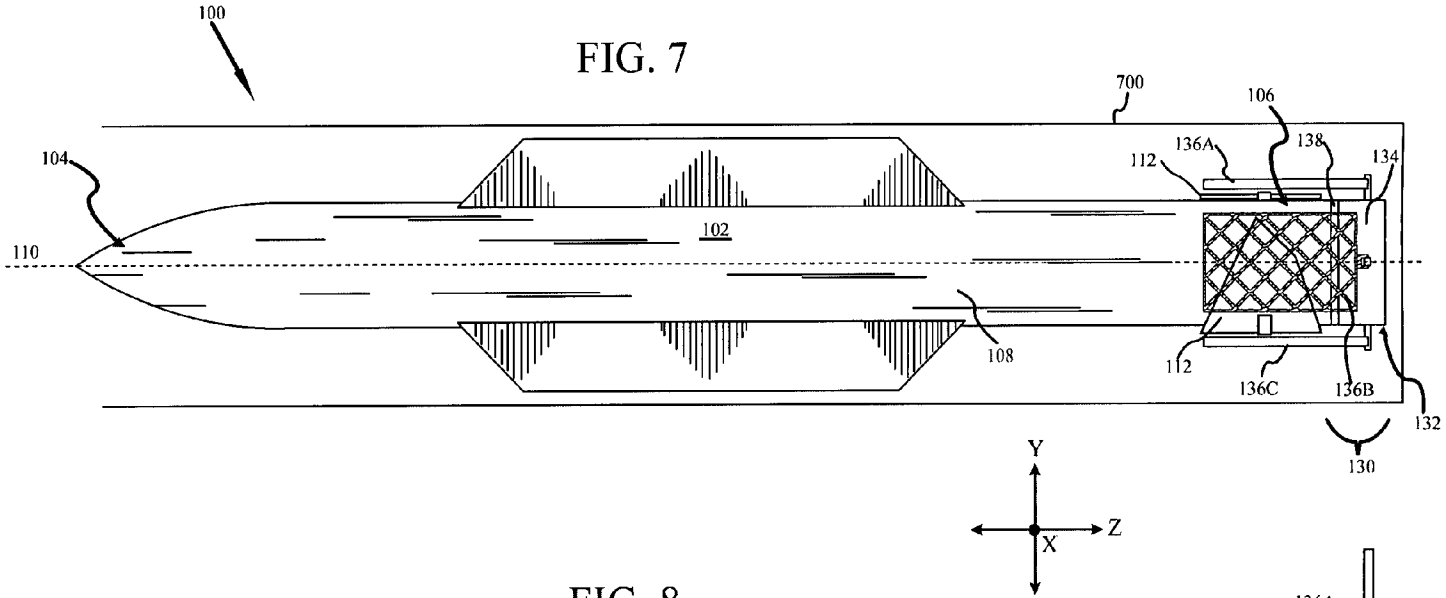
FIG. 7 is a side view of a missile with a detachable aerodynamic missile stabilizing system according to an embodiment within a canister.
Figure 8:
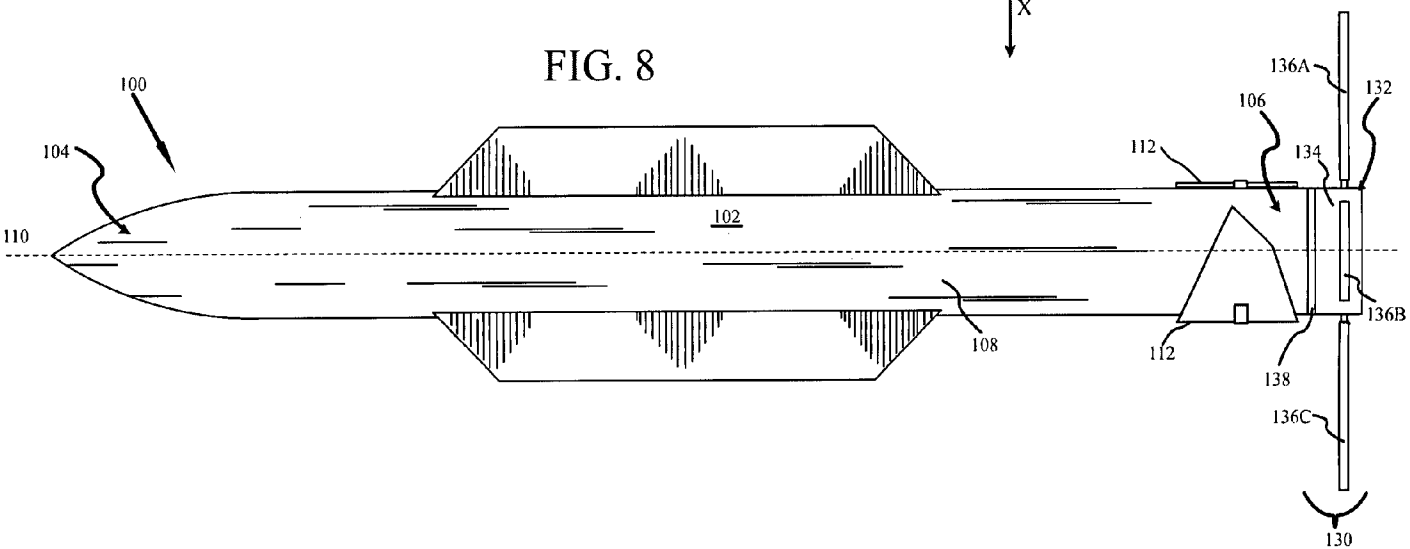
FIG. 8 is a side view of the missile with a detachable aerodynamic missile stabilizing system as shown in FIG. 7, now launched from the canister with the grid fins deployed.
Figure 9:
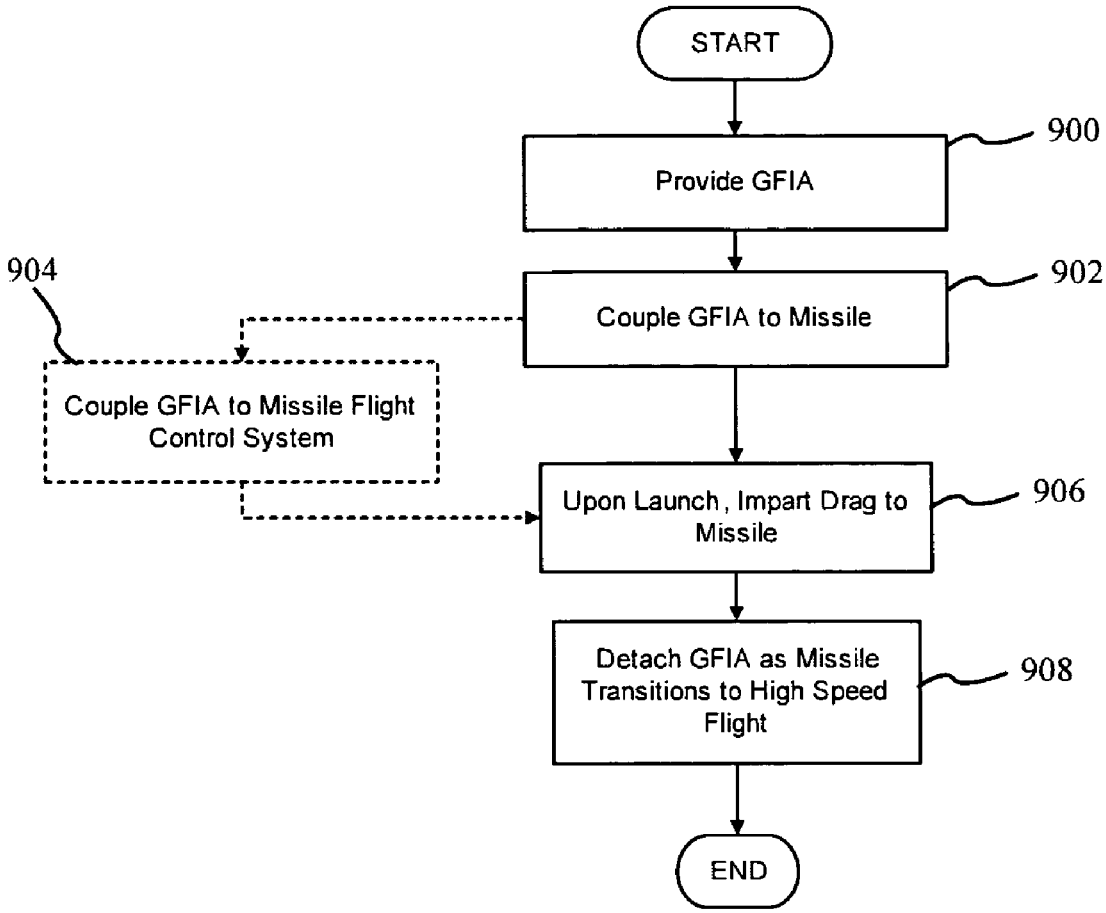
FIG. 9 is a high level flow diagram illustrating the method of using a detachable aerodynamic missile stabilizing system in accordance with at least one embodiment.

FIG. 7 provides a side illustration of missile 100 disposed within a canister 700. Tail fins 112 are shown folded against the body 102, and grid fins 136 are shown folded over the tail fins 112. Upon launch, as soon as the missile 100 clears the canister 700, the grid fins 136A~136D will deploy as shown in FIG. 8. As shown in FIG. 8, in at least one embodiment, the tail fins 112 may remain against the body 102 as missile velocity is sub-optimum for their effectiveness. In an alternative embodiment, the tail fins 112 may deploy as well. Having discussed the structural embodiments of the detachable aerodynamic missile stabilizing system 130, the method of use will now be described with reference to the above figures and the flow diagram of FIG. 9. It will be appreciated that the described events and method of use need not be performed in the order in which it is herein described, but that this description is merely exemplary of one method of operation in accordance with the present invention.

In at least one embodiment, the method of providing detachable aerodynamic missile stabilization commences with the providing of a GFIA 132 as discussed above, block 900. In at least one embodiment the GFIA 132 is as described with respect to FIGS. 2, 3, 4, 7 and 8 in that it has four grid fins 136A~136B. In at least one alternative embodiment, the GFIA 132 is as described with respect to FIGS. 5 and 6 in that it has a single circumferential grid fin 136E.

The provided GFIA 132 is coupled to the aft portion of the missile, as in block 902. It is appreciated that GFIA 132 is intended to be retrofit to existing missiles and does not require modification of the existing missile for the coupling to be performed. It is further appreciated that the providing of the GFIA 132 and coupling to the missile 100 may be performed well in advance of the missile being placed in the canister or other launch environment. Indeed, GFIA 132 coupling may be performed in the field when and as deemed necessary to respond to perceived local threats, or it may be performed at a factory before deployment.

In at least one embodiment, the coupling is accomplished with the use of a Marman clamp engagement system. In at least on optional embodiment, wherein the grid fins are operable to articulate, the coupling of the GFIA 132 to the missile also couples the grid fin articulation system to the missile flight control system, optional block 904.

Following the missile launch, the grid fins 136 deploy and impart lift and drag to the missile. The grid fins 136 thereby stabilize the missile and permit accelerated pitch over and flight path alignment for target acquisition before the missile has reached high flight speed, block 906. When an embodiment of GFIA 132 providing at least four grid fins 136 is utilized, upon launch the grid fins will deploy from the stowed position shown in FIG. 7 to the operable position shown in FIG. 8.

For the optional embodiment utilizing articulating grid fins, the missile control system is operable to articulate the grid fins 136 and thereby further control the induced lift and drag so as to provide enhanced low speed aerodynamic stabilization. In at least one embodiment the grid fins are slaved to the traditional tail fins 112, which is to say that they move in coordinated harmony. In at least one alternative embodiment, the missile control system is operable to articulate the grid fins independent from the tail fins.

When the missile has performed the desired pitch over and is transitioning to high speed flight, the GFIA 132 is released, block 908. By releasing GFIA 132, missile 100 is able to reduce weight and utilize its intended high speed flight capabilities without encumbrance.

As GFIA 132 does not impede the plume, it is understood and appreciated that if desired, an additional interstage unit could be attached to the aft end of the GFIA 132, such as for example an additional booster motor or a jet vain control system.

With respect to FIGS. 1~8, it is understood and appreciated that GFIA 132, and specifically the grid fin(s) 136 are not necessarily rendered to scale with respect to missile 100. Rather, especially in the case of FIG. 1 the relative size of the grid fins 136 may be viewed as exaggerated for ease of illustration and discussion.

Changes may be made in the above methods, systems and structures without departing from the scope hereof. It should thus be noted that the matter contained in the above description and/or shown in the accompanying drawings should be interpreted as illustrative and not in a limiting sense. The following claims are intended to cover all generic and specific features described herein, as well as all statements of the scope of the present method, system and structure, which, as a matter of language, might be said to fall therebetween.

What is claimed is:

1. A detachable aerodynamic missile stabilizing system for stabilizing a missile at subsonic speeds, the missile having a forward portion and an aft portion, comprising:

a grid fin interstage assembly including a housing configured to be coupled to the aft portion, a plurality of grid fins disposed on an exterior of the housing and movable between a stowed position and a deployed position extending transversely from a longitudinal axis of the housing, the grid fins having a plurality of apertures, and an articulation control system configured to control an orientation of the grid fins and to link with a missile control system; and at least one coupler configured to attach the grid fin interstage assembly to the missile at the aft portion and further configured to release the grid fin interstage assembly from the aft portion to dispose of the grid fin interstage assembly at subsonic speeds.

2. The aerodynamic stabilizing system of claim 1, wherein the apertures are arranged in a grid pattern, the apertures parallel to a longitudinal axis of the housing.

3. A detachable aerodynamic missile stabilizing system for stabilizing a missile at subsonic speeds, the missile having a forward portion and an aft portion, comprising:

a grid fin interstage assembly including a housing configured to be coupled to the aft portion, and a grid fin disposed on an exterior of the housing, the grid fin having a plurality of apertures and the grid fin being a single grid fin extending circumferentially and annularly about the housing; and at least one coupler configured to attach the grid fin interstage assembly to the missile at the aft portion and further configured to release the grid fin interstage assembly from the aft portion to dispose of the grid fin interstage assembly at subsonic speeds.

4. The aerodynamic stabilizing system of claim 1, wherein the grid fins are symmetrically disposed about the housing.

5. The aerodynamic stabilizing system of claim 4, wherein the grid fins are operable to articulate.

6. The aerodynamic stabilizing system of claim 4, wherein the coupler couples the grid fins to a control system disposed within the missile.

7. The aerodynamic stabilizing system of claim 4, wherein the grid fins are aligned between the tail fins.

8. The aerodynamic stabilizing system of claim 1, wherein the grid fins provide control surfaces operable to provide lift.

9. The aerodynamic stabilizing system of claim 1, wherein the grid fins include mesh.

10. The aerodynamic stabilizing system of claim 1, wherein each grid fin includes two primary opposing sides transverse to the longitudinal axis, and the plurality of apertures are disposed between the opposing sides and are parallel to the longitudinal axis.

* * * * *